US005943710A

United States Patent [19]

Takagi et al.

[11] Patent Number: 5,943,710

[45] Date of Patent: Aug. 31, 1999

[54] WATER JET GENERATING SYSTEM IN BATHROOM

[75] Inventors: Kazumi Takagi; Michihiro Shimizu; Kenji Takagi; Kenichi Ito; Masaru Mochizuki, all of Fuji, Japan

[73] Assignee: Takagi Industrial Co., Ltd., Fuji, Japan

[21] Appl. No.: 09/010,064

[22] Filed: Jan. 21, 1998

[30] Foreign Application Priority Data

Feb. 17, 1997 [JP] Japan ..... 9-032047

[51] Int. Cl.[6] ..... A47K 3/02

[52] U.S. Cl. ..... 4/541.1

[58] Field of Search ..... 4/541.1, 541.3, 4/541.4, 541.6, 559

[56] References Cited

U.S. PATENT DOCUMENTS 4,424,438 1/1984 Antelman et al. ..... 4/541.1 X

*Primary Examiner*—Robert M. Fetsuga

*Attorney, Agent, or Firm*—Pollock, Vande Sande & Amernick

[57] ABSTRACT

The invention provides a water jet generating a system capable of applying water jet massage while a bather takes a bath by generating water jet at an appropriate pressure. More specifically, water is sucked in from a water source or a bathtub by a pump, and water jet is spouted out at an appropriate pressure through water jet spouting means or a nozzle so as to generate water jet in the bathtub. The water jet can beat at the surface of the body of the bather, and a complex stimuli caused by thermal effect of water or hot water and pressure of water jet and friction occurring between the water jet and the skin of the bather can be applied to the skin of the bather, attaining massaging effects of the water jet with ease.

5 Claims, 10 Drawing Sheets

WATER JET GENERATING SYSTEM IN BATHROOM

BACKGROUND OF THE INVENTION

1. Field of the Invention

The invention relates to a water jet generating system in a bathroom adapted for use in a body massage by generating water jet injected to skin of a human body using hot and cold water.

2. Description of the Related Art

Kinetic massage similar to that given by finger-pressure therapy can be applied to the body of a person taking bath, taking advantage of localized pressurization of, or impact to the body caused by a pressure of water jet, or friction occurring between the water jet and the skin of the body when the water jet at an appropriate pressure is caused to beat at the surface of the skin. This type of treatment making use of hot water as the water jet can provide massaging effects for recovery from fatigue or promotion of health. It is well known that massaging given in a hot bath utilizing hot water jet is effective in refreshing the body, coupled with beneficial effects of taking a dip in the hot bath, and by injecting water jet, immeasurably beneficial effects are expected . This type of massaging systems have been disclosed in Japanese Utility Model Registration No. 2502192 under the title "Beauty Promotion System in Bath", Japanese Patent Laid-open H1-178028 "Liquid Jet Type Massaging System", and so on.

However, there have been very few massaging systems utilizing water jet which can be put to use at home with ease because of such problems as needs for installing an elaborate apparatus for generating high pressure water jet for use in a bathtub at home, inconvenience in handling, and the like.

SUMMARY OF THE INVENTION

It is therefore an object of the invention to provide a water jet generating system in a bathroom capable of applying water jet massage or the like while taking a bath by producing water jet at an appropriate pressure.

With the water jet generating system in a bathroom according to the invention, as shown in FIGS. 1 to 11 by way of example, water is sucked in from a water supply source (bathtub 4) by way of a pump (10), so that water jet (W) at an appropriate pressure is injected through a nozzle (16) so as to generate water jet in the bathtub. The water jet can be applied to the surface of the bather's body by water jet injecting means so that massaging effects by simple water jet can be attained by application of combined stimulation of the pressure, impact or friction by the water jet in addition to a thermal effect by cold or hot water.

The water jet generating system in a bathroom according to the invention comprises a water intake soaked in hot water in a bathtub, water jet generating means provided in a bathroom for generating a water jet, the means having a pump for sucking in hot water in the bathtub through the water intake, water jetting means connected to the water jet generating means for jetting hot water in the bathtub, control means for controlling operation of the pump, and power source means for supplying power to the control means and for supplying driving power having low voltage to the pump.

With the system constructed as above, the pump of the water jet generating means is supplied with power by the power source means, by operation of which the water in the bathtub can be sucked in so as to generate water jet to be injected by the water jet injecting means. Massaging effects superior to manual therapeutics can be expected for the skin by application of combined stimulation of the pressure, impact or friction by the water jet in addition to a thermal effect by cold or hot water.

The power source means can be provided separately from the water jet generating means and outside the bathroom. By installing the power source outside the bathroom, so as to further enhance safety by insulating the bathroom.

The water jet generating system is characterized in that the water jet generating means has a setup operation switch, and the water jetting means has an operation switch, wherein the control means operates the pump when it receives input of the operation switch after receiving a setup instruction from the setup operation switch. With such a structure, more reliable safety can be realized.

Other objects, features, and advantages of the invention will become apparent from the following description of embodiments and examples with reference to the accompanying drawings.

DETAILED DESCRIPTION OF THE PREFERRED EMBODIMENTS

Figure 1:
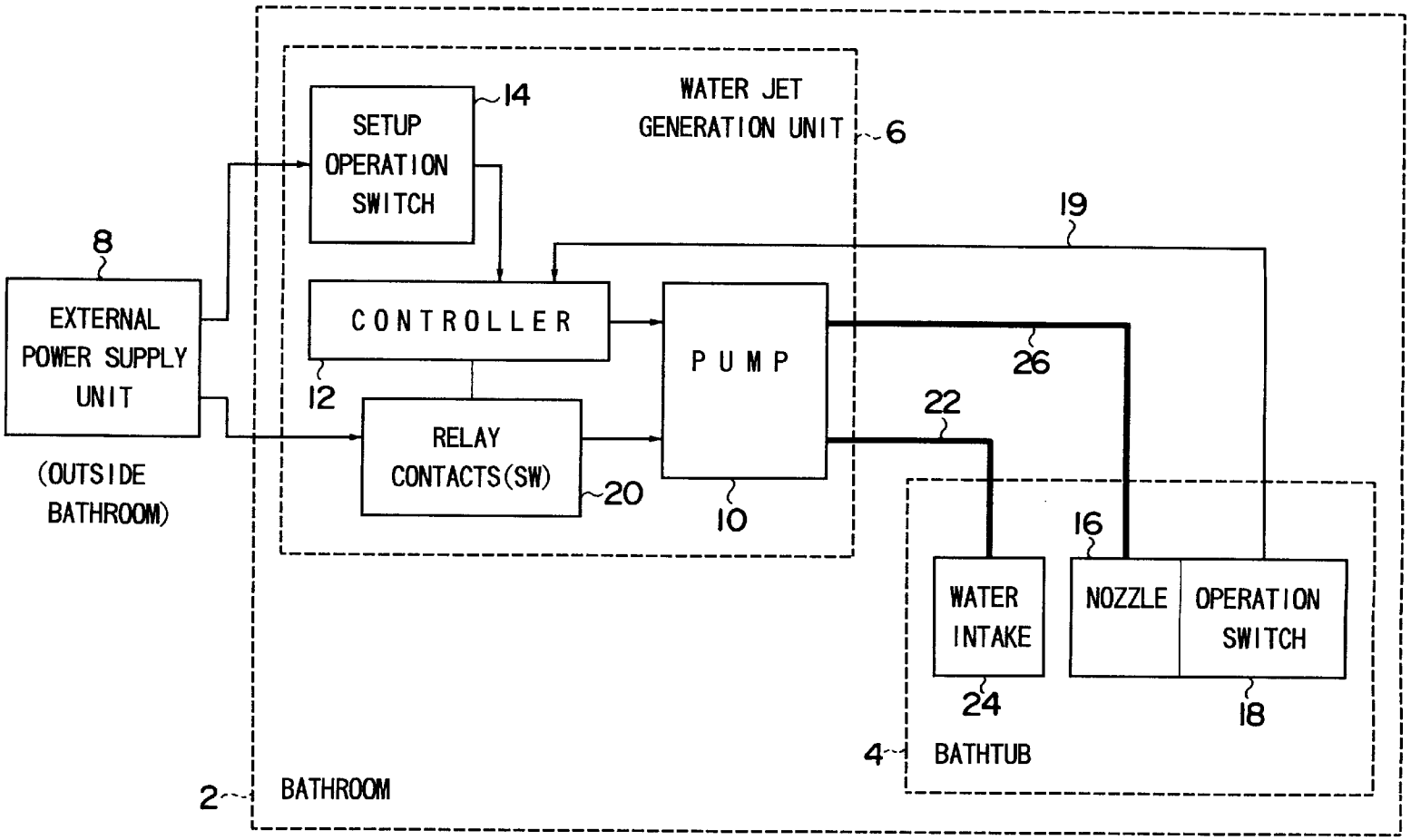
FIG. 1 is a view illustrating an embodiment of a water jet generating system in a bathroom according to the invention.

The invention is described in detail hereinafter with reference to embodiments thereof shown in the drawings.

FIG. 1 is a view illustrating an embodiment of a water jet generating system in a bathroom according to the invention. A water jet generation unit 6 for generating a water jet is installed together with the bathtub 4 in a bathroom 2. The water jet generation unit 6 is installed in an area adjacent to the bathtub 4 so as to be manipulated, and is, for example, fixed to a wall of the bathroom 2. The water jet generation unit 6 is supplied with electric power from an external power supply unit 8 as a power supply means installed outside the bathroom 2. The reason that the external power supply unit 8 is installed outside the bathroom 2 is for separating the water jet generation unit 6 from the power source so as to secure safety.

The water jet generation unit 6 includes a controller 12 as means of controlling a pump 10. The pump 10 is supplied with low voltage power transformed from a commercial AC power by the external power supply unit 8. The controller 12 is supplied with DC power from the external power supply unit 8 through a setup operation switch 14, and is applied with operation input signals by way of a cable 19 from an operation switch 18 installed together with a nozzle 16 as means of injecting water jet in the bathtub 4. The pump 10 is supplied with AC voltage transformed by the external power supply unit 8 by way of relay contacts (SW)20. The pump 10 is connected with a water intake 24 by way of a suction pipe 22 at its water intake side, and with a nozzle 16 by way of a water supply pipe 26 at its water feeding side. The water intake 24 is immersed in the bathtub 4.

Figure 2:
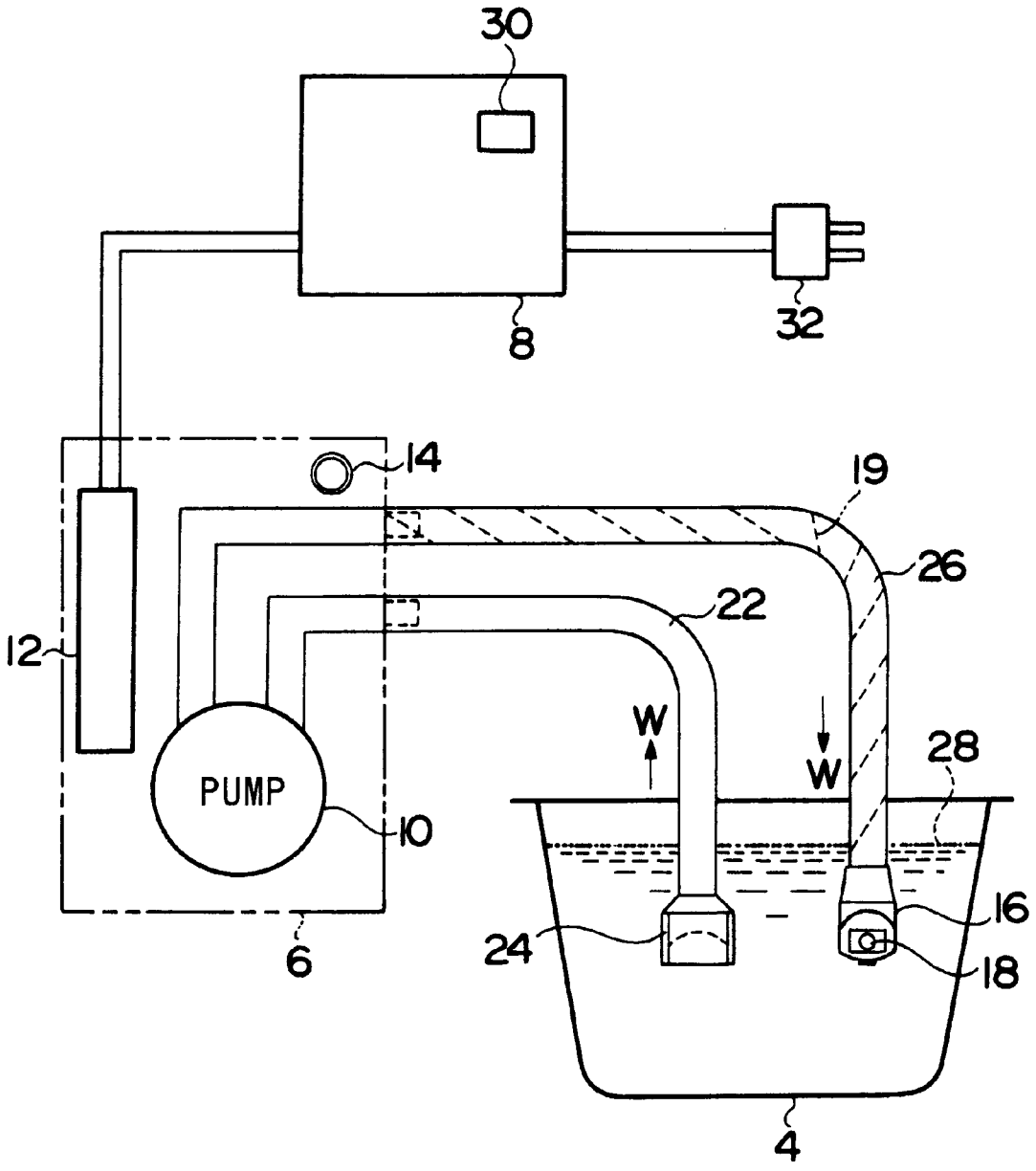
FIG. 2 is a view illustrating an embodiment of a water jet generating system in a bathroom according to the invention;.

FIG. 2 is a view illustrating an embodiment of a water jet generating system in a bathroom according to the invention. In the embodiment, hot water contained in a bathtub 4 is used as a water source, however, tap water from water service or the like may be used as well. A water jet generation unit 6 is installed in an area adjacent to the bathtub 4. The water jet generation unit 6 makes up means for delivering water jet whereby hot water 28 is sucked in from the bathtub 4, and returned under an appropriate pressure to the bathtub 4. The arrow denoted by W indicates the direction of water flow. The water suction pipe 22 is a flexible pipe formed of elastic synthetic resin, and the like. The nozzle 16 is linked with the pump 10 via a water supply pipe 26. The water supply pipe 26 is also a flexible pipe formed of elastic synthetic resin, and the like, in which the cable 19, that is, a signal line for electrically connecting an operation switch 18 installed in the nozzle 16 with a controller 12.

The controller 12 is a means for controlling driving of the pump 10. Power is supplied to the controller 12 from the external power supply unit 8, and supply of power is turned on or off by an operation switch 30. The external power supply unit 8 is connected with a wall outlet supplied with AC power.

For operation of the water jet massaging system described above, power is supplied to the external power supply unit 8, and the setup operation switch 14 of the water generation unit 6 is turned ON. Then, a user can generate water jet W, and cause same to beat at desired spots of the body by holding the nozzle 16 in one hand and manipulating the operation switch 18 after dipping the water intake 24 and the nozzle 16 in the hot water 28 in the bathtub 4. As a result, massaging effects are obtained by applying hot water, cold water, and pressurization of water flow.

Figure 3:
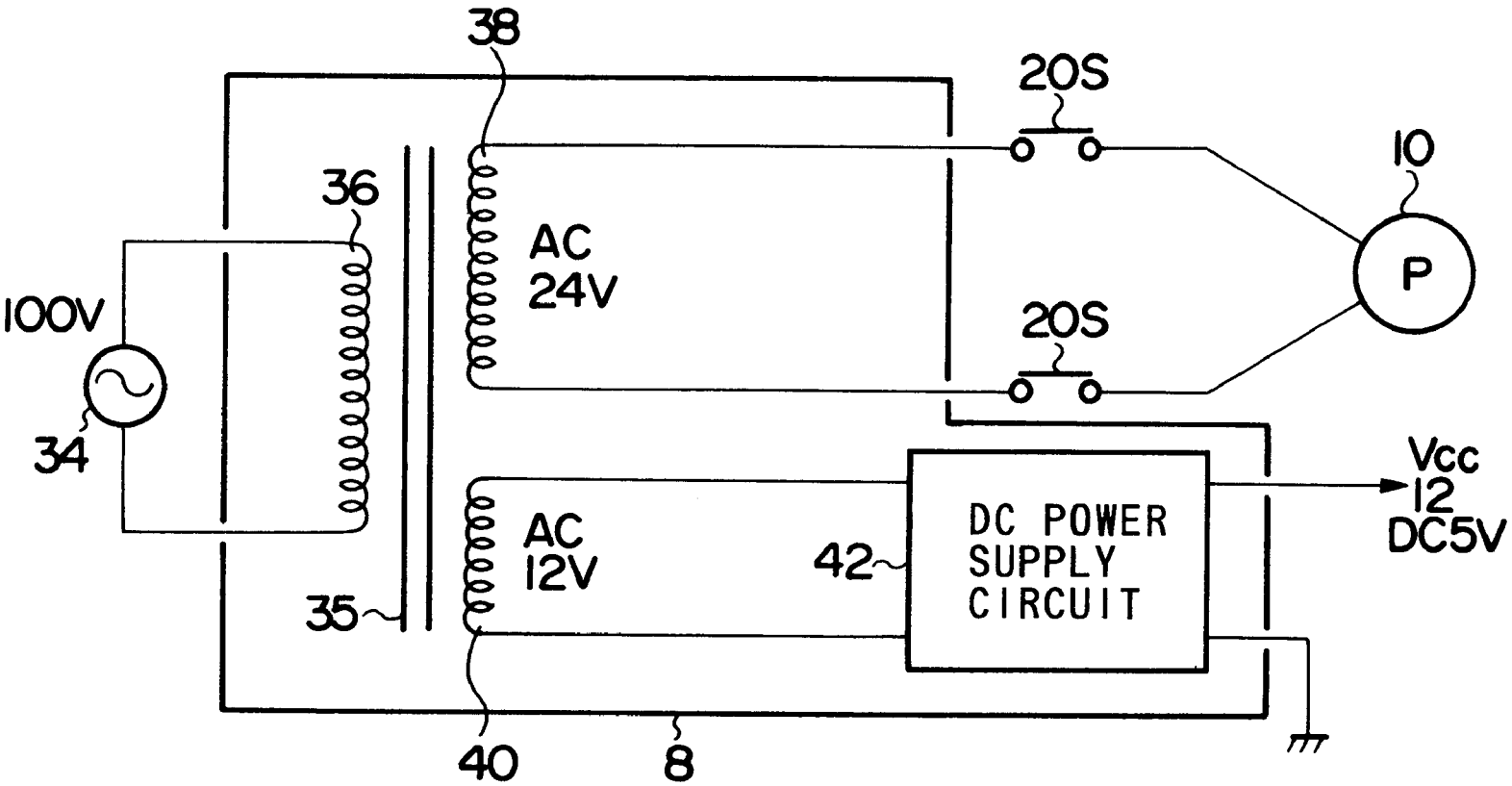
FIG. 3 is a block diagram showing an external power supply unit.

FIG. 3 illustrates an embodiment of the external power supply unit 8 of the system according to the invention. The external power supply unit 8 is installed separately to enhance safety by insulating the bath room from the commercial AC power source 34 and providing a low voltage power source inside the bath room. The external power supply unit 8 is provided with a transformer 35, a primary coil 36 of which is connected to the commercial AC power source 34. The transformer 35 is provided with two secondary coils 38 and 40. A low voltage a-c is outputted from the secondary coil 38, and supplied to the pump 10 via two relay contacts 20S. The other secondary coil 40 is connected to a DC power supply circuit 42 for outputting DC to the controller 12.

Figure 4:
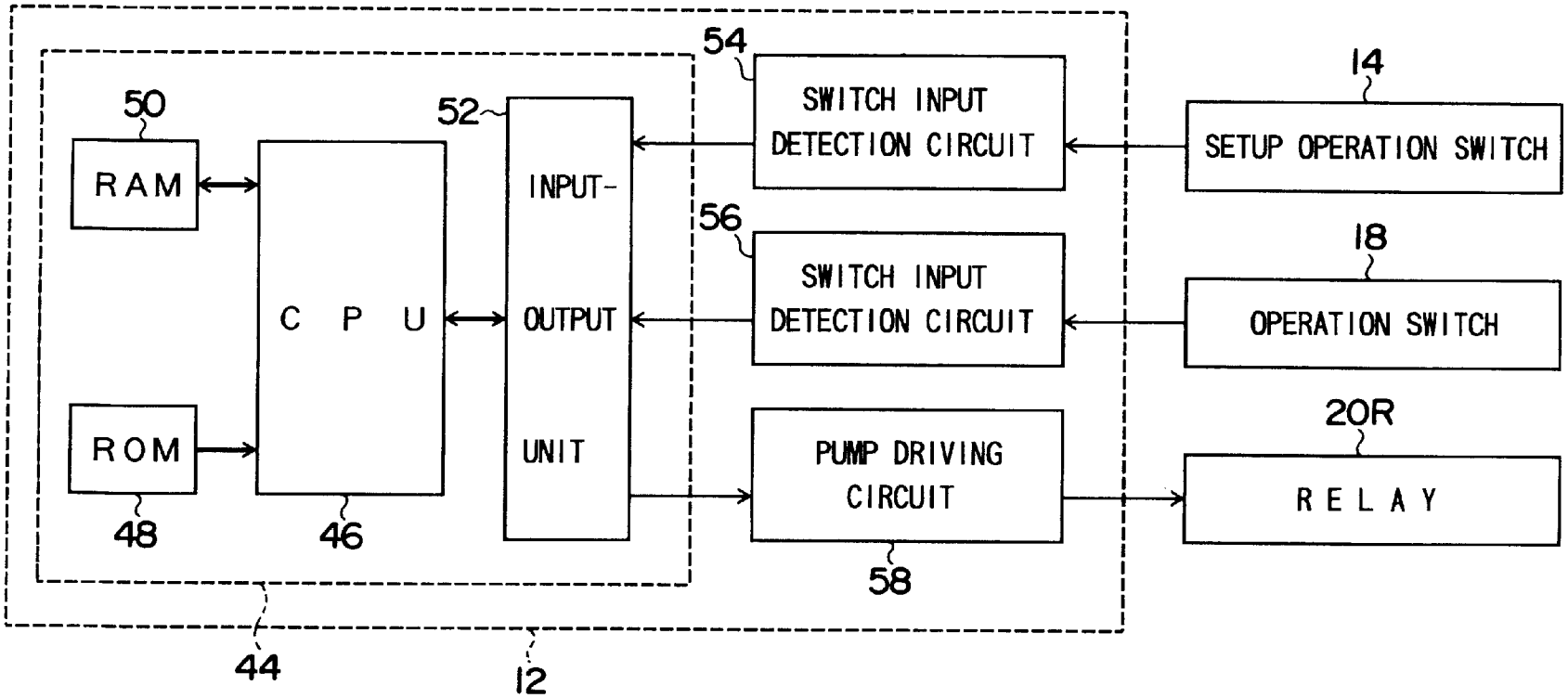
FIG. 4 is a block diagram showing a controller.

FIG. 4 is a block diagram showing the construction of the controller 12. The controller 12 is provided with a microcomputer 44 comprising a CPU 46 as means for computing, a ROM 48 and a RAM 50 as means for storing information, and an input-output unit 52. Signals for ON or OFF from the setup operation switch 14 are delivered to the input-output unit 52 via a switch input detection circuit 54. Signals for ON or OFF from the operation switch 18 are also delivered to the input-output unit 52 via another switch input detection circuit 56. Then, in controlling supply of power to the pump 10, control signals from the input-output unit 52 are delivered to a pump driving circuit 58, output from which controls excitation of a relay 20R of a solenoid, opening or closing the two relay contacts 20S.

The controller 12 controls detection of manipulation of the switches, and operation of the pump 10. The controller 12 shifts to an operation standby mode when detecting an input for operation from the setup operation switch 14 for a predetermined length of time continuously. Unless the setup operation switch 14 is so pressed the input is not taken as a signal for starting operation, thus preventing generation of water jet even if the operation switch 18 is activated inadvertently. In this way, safety is enhanced. In the operation standby mode, generation of a water jet can be completed by manipulation of the operation switch 18. Every time an input by the operation switch 18 of the nozzle 16 is detected after shifting to the operation standby mode, the relay 20R is activated, driving or stopping the pump 10. A bather can hold the nozzle 16 in one hand while turning ON the operation switch 18. For example, a momentary switch as means for avoiding a constant ON-condition may be used for the setup operation switch 14 and the operation switch 18. When activation of the setup operation switch 14 is detected, the operation standby mode is released, and the controller returns to OFF-condition. When the controller shifts to an operation mode after detecting activation of the operation switch 18, and then after the elapse of a predetermined length of time, both the operation mode and operation standby mode are released, turning the pump 10 in OFF-condition.

The controller 12 performs computation of lengths of operation times of the pump 10 on the basis of manipulation of the operation switch 18, and when the aggregate length of the operation times reaches a predetermined length of time, excitation of the relay 20R is released, stopping operation of the pump 10. As operation times are thus restricted, extreme prolongation of time for massaging by the bather can be prevented. Furthermore, as unnecessary driving of the pump 10 is avoided.

A predetermined DC voltage is always supplied from the external power supply unit 8 to the controller 12, the CPU 46 monitors by sampling via the switch input detection circuits 54, 56, whether or not there has been any input in the setup operation switch 14 and the operation switch 18. When an input in the setup operation switch 14 is detected, the CPU 46 sets the flag to store information in the RAM 50, and monitor by sampling whether or not detection has been made for a predetermined length of time continuously. After detection of the predetermined length of time, the controller 12 shifts to the operation standby mode. Upon detection of an input in the operation switch 18, the pump driving circuit 58 is activated, exciting the relay 20R, closing the relay contacts 20S, applying a driving voltage for driving the pump 10, and generating water jet W. Unless a new input in the operation switch 18 is detected after lapse of a predetermined length of time that the has been driven by the CPU 46, the pump 10 is caused to stop while the system is shifted to an OFF condition.

Figure 5:
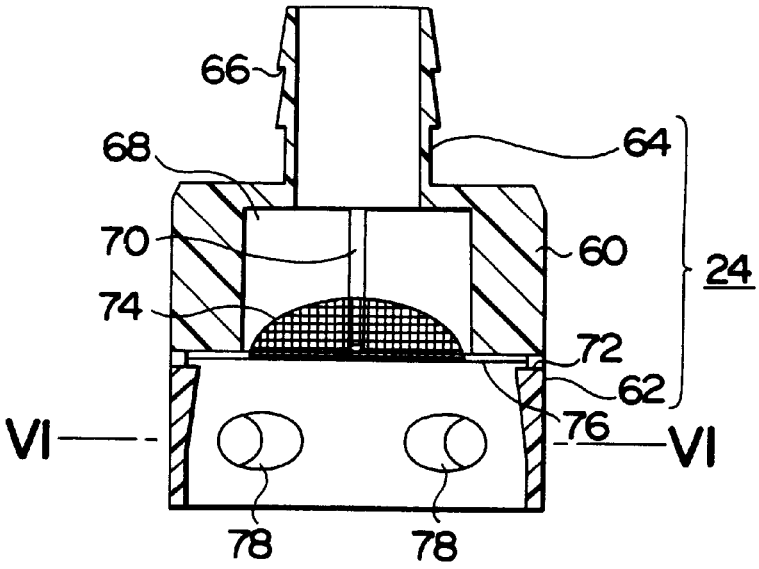
FIG. 5 is a transverse cross section of the water intake.
Figure 6:
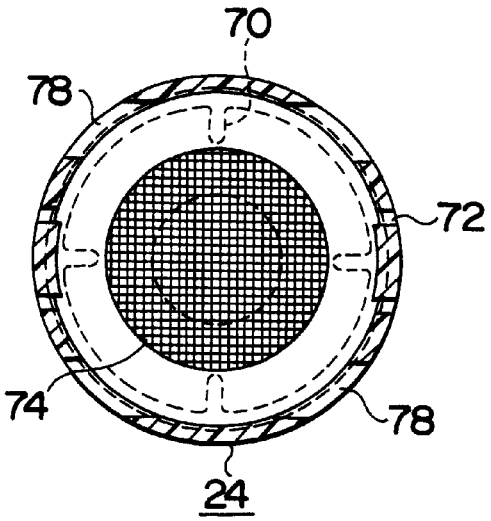
FIG. 6 is a cross section of the water intake taken on line VI—VI in FIG. 5.
Figure 7:
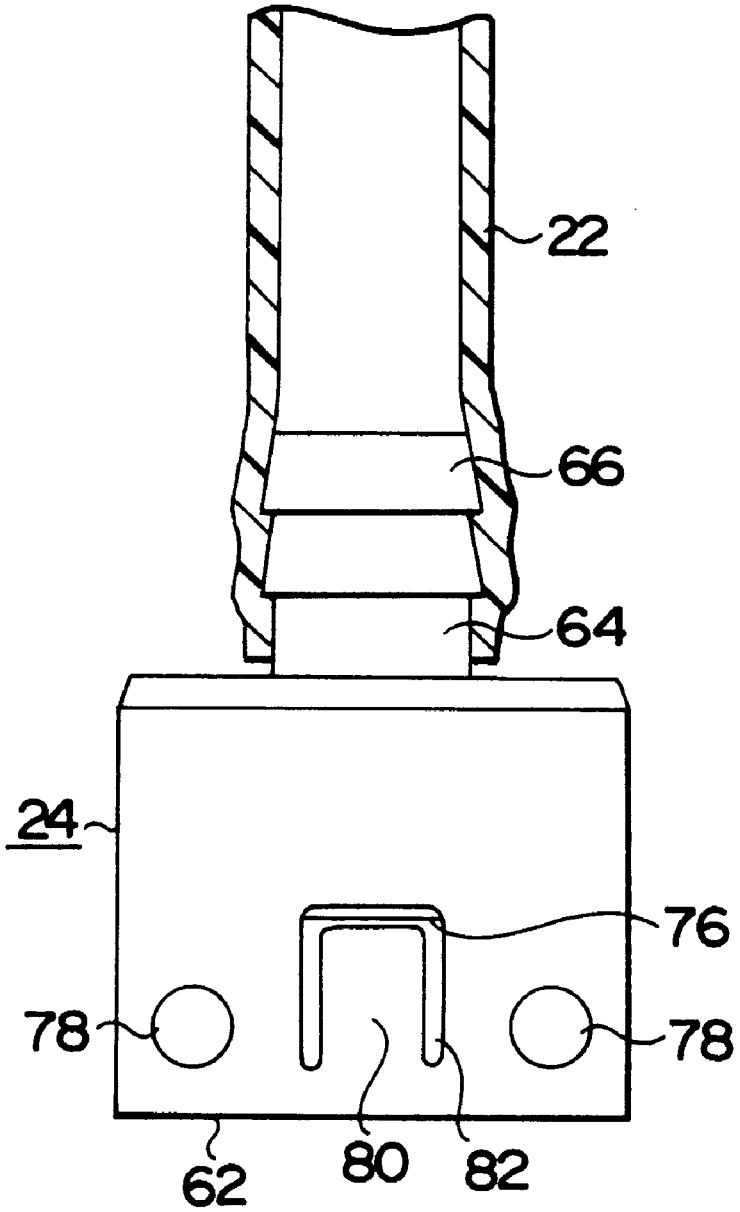
FIG. 7 is a side view illustrating a water intake.

FIGS. 5 to 7 show the construction of the water intake 24. FIG. 5 is a vertical sectional view of the water intake 24, FIG. 6 a transverse cross section thereof taken on line VI—VI in FIG. 5, and FIG. 7 a view showing the water suction side of the water intake 24.

The water intake 24 comprises a main body 60, a skirt section 62, and a coupling 64. The skirt section 62 is an embodiment of a partition wall for partitioning a suction pressure at work on the main body 60 from the external side. The main body 60, the skirt section 62, and the coupling 64 are formed of, for example, synthetic resin, cylindrical in shape, and linked with a water suction pipe 22. The coupling 64 is provided with a stopper 66 having the surface with protrusions and depressions such that the water intake is securely linked with the water suction pipe 22. A cavity 68 in the shape of a cylinder with the diameter larger than that for the coupling 64 is formed inside the main body 60, and a plurality of ridges 70 are formed on the inner wall thereof in such a way as to be protruded towards the center of the main body 60. In this embodiment, four ridges are provided 902 apart around the inner wall, however, more than or less than four ridges may be provided. A groove 72 is formed on the inner circumferential surface of the main body 60 between the main body 60 and the skirt 62, and a filter 74 is securely fitted in the groove 72 by a holding frame 76. The filter 74 prevents foreign matters contained in the bathtub 4 from being sucked in. In this embodiment, a net filter is illustrated, however, various other filters may obviously be also used. The skirt section 62 cylindrical in shape has the underside open, forming a window for incoming water, and provided with a plurality of through-holes 78 formed on the circumferential wall thereof, serving as water passages. On the sidewall of the skirt section 62, a protruding piece 80 made of the same synthetic resin as that making up the skirt section 62 is formed with a through-groove 82, preventing the holding frame 76 from falling off.

With the water intake constructed as above, a sucking force of the pump 10 acting on the water intake 24 when water is sucked in is dispersed in various directions since the through-holes 78 formed in the skirt section 62 are open in different directions while the skirt section 62 is open downward. Consequently, even in event that the water intake 24 comes in contact with the body or the inner wall of a bathtub, sticking of the water intake 24 does not occur. Accordingly, clogging of the water intake 24 is prevented, avoiding stoppage in suction of water while an user does not feel discomfort due to sticking of the water intake 24 to the body.

Further, as foreign matter contained in the hot water 28 sucked into the water intake 24 is screened by the filter 74, these are neither sucked into the pump 10 nor injected into the body through the nozzle 16. The filter 74 can be removed together with the holding frame 76 by extending the protruding piece 80 towards the periphery of the skirt section 62 so that the filter 74 is reusable after cleaning.

Figure 8:
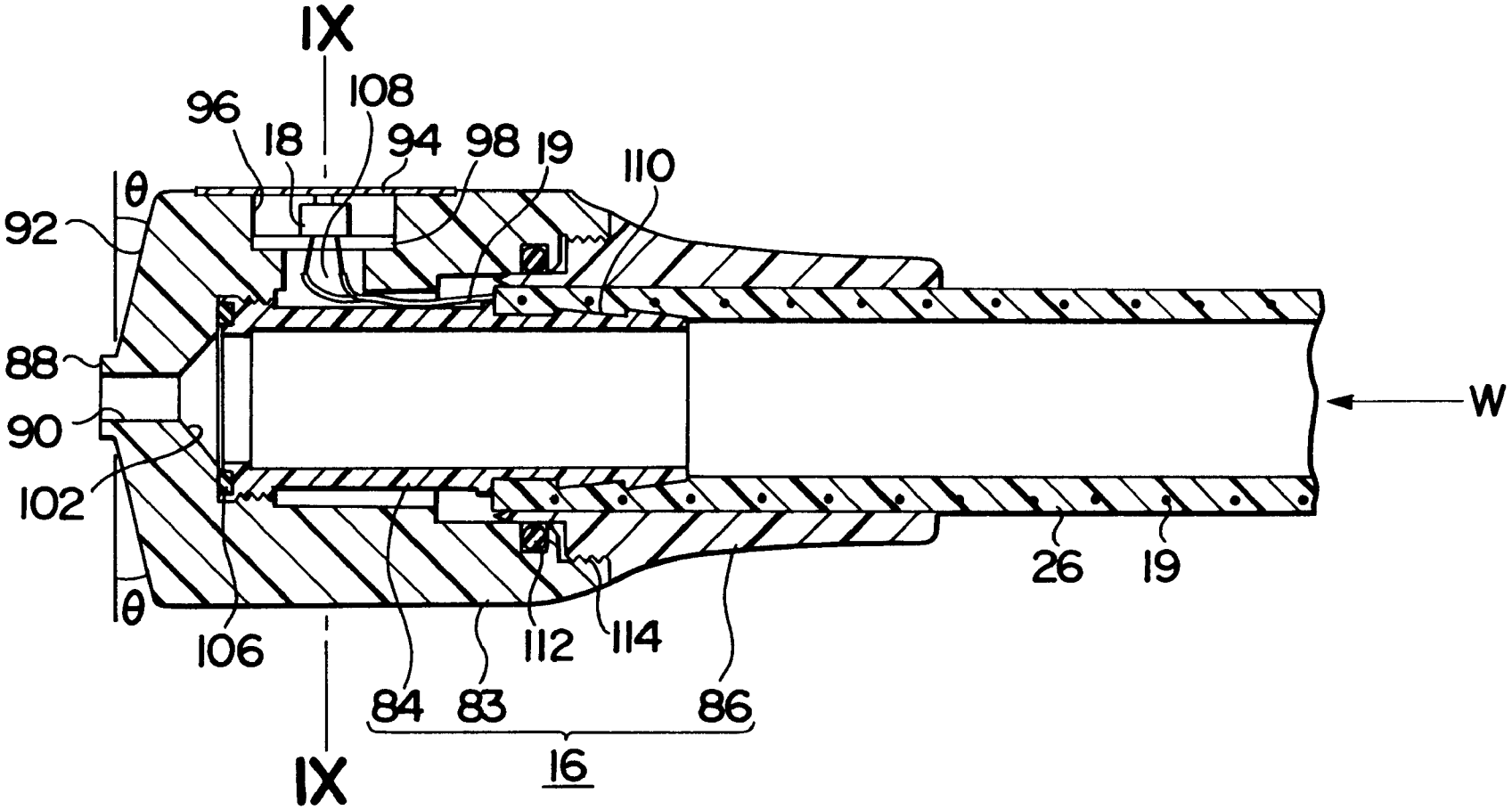
FIG. 8 is a transverse cross sectional view illustrating a nozzle.
Figure 9:
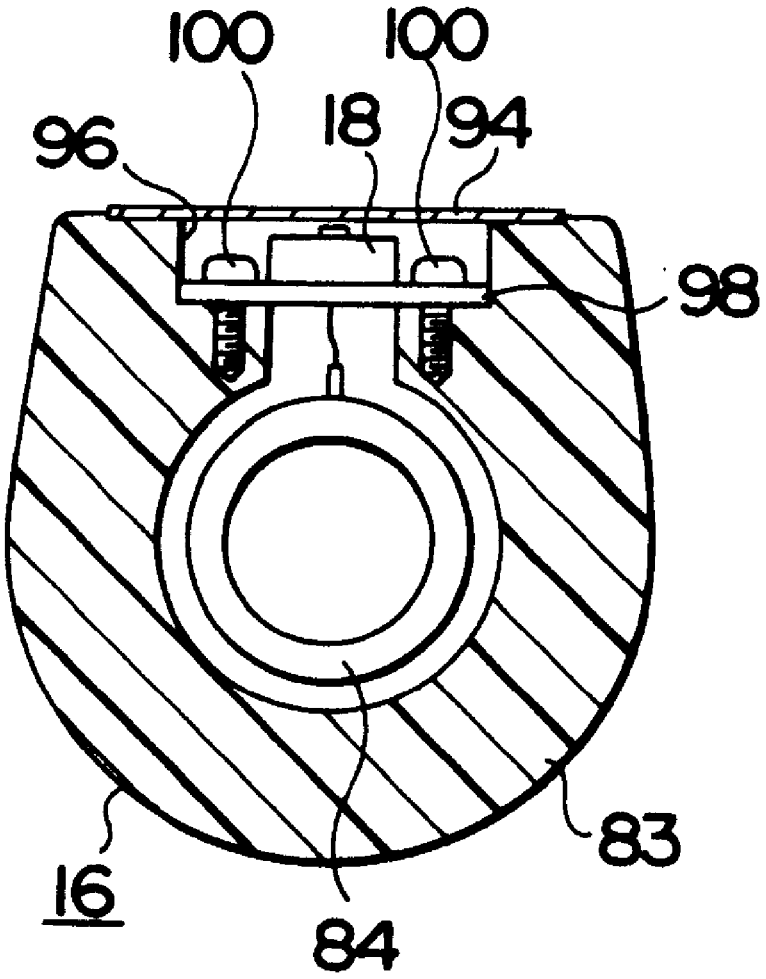
FIG. 9 is a sectional view of the nozzle taken on line IX—IX in FIG. 8.
Figure 10:
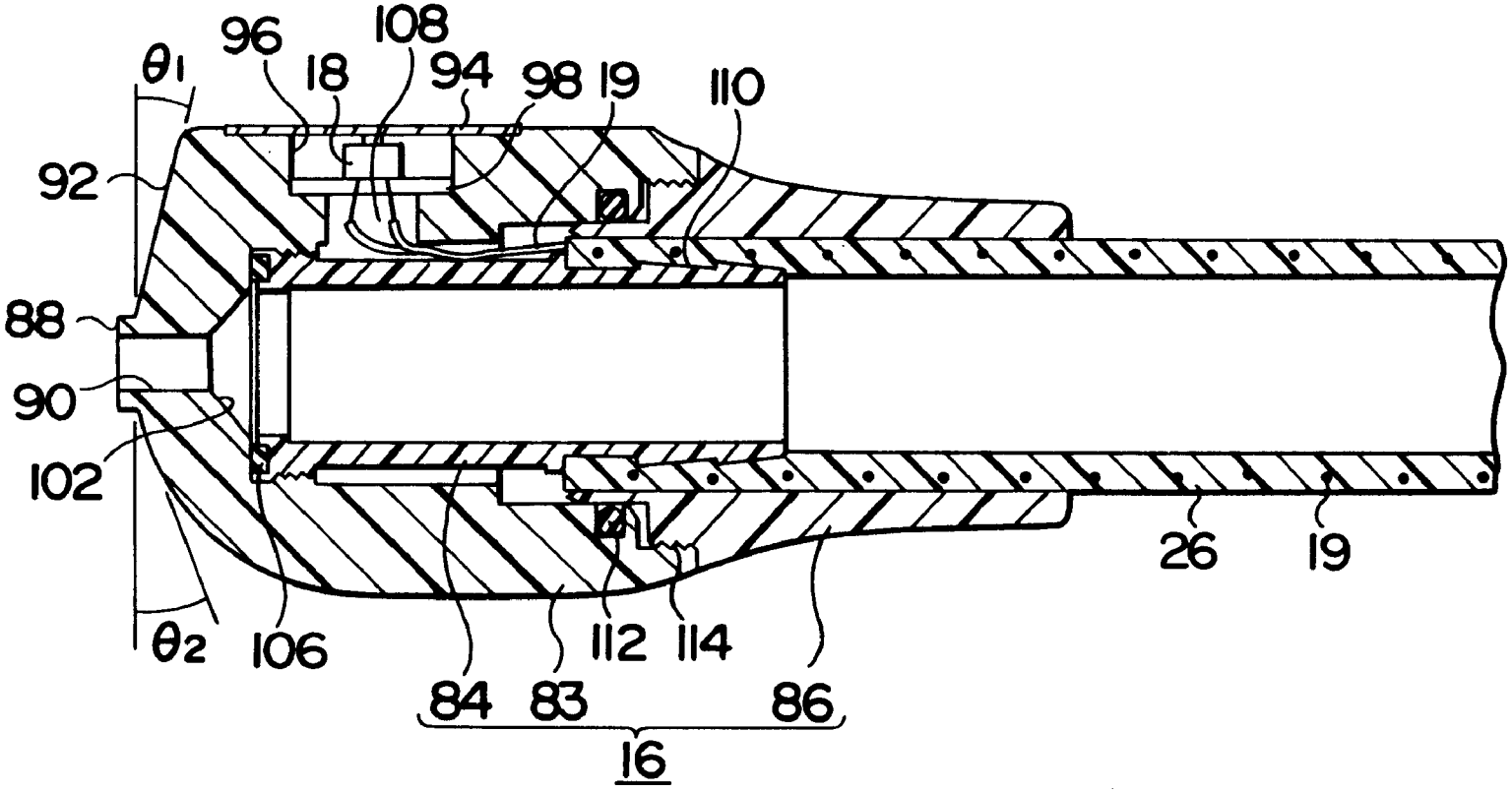
FIG. 10 is a transverse cross section of the nozzle according to another embodiment.

FIGS. 8 to 10 show the construction of the nozzle specifically, and FIG. 9 is a transverse cross section of the nozzle taken on line IX—IX in FIG. 8.

The nozzle 16 comprises a main body 83, a water supply pipe joint 84, and a water supply pipe holder 86. The main body 83 is, for example, a molded synthetic resin, cylindrical in shape and of a size suitable to be held in one hand, and provided with a water supply port 88 on the wall at the front end thereof. The water supply port 88 is slightly projected from the surface at the tip of the main body 83, and provided with an orifice 90 for spouting water, circular in shape, therein. On the front end side of the main body 83, a tapered surface 92, receding from the external wall surface of the water supply port 88, and forming a tilt angle of θ therewith, is provided. Further, a cavity 96 is formed in the external wall of the main body 83, and is closed by an elastic sheet cover 94. Inside the cavity 96, the operation switch 18 is installed. As shown in FIG. 9, the operation switch 18 together with a base board 98 are fixedly attached to the main body 83 by screws 100, and the operation switch 18 is connected with a cable 19 embedded in the water supply pipe 26.

Inside the main body 83, the orifice 90 for spouting water is formed into a bore section of expanding diameter 102 having inclined wall surface, and linked with the front extremity of the water supply pipe joint 84 screwed onto the bore section of expanding diameter 102 via a packing 106. A space 108, which is in watertight condition, is formed between the water supply pipe joint 84 and the main body 83, and the cable 19 is disposed in the space 108.

A stopper section 110 of the same diameter as that for the water supply pipe joint 84, and having the surface with protrusions and depressions formed thereon in a sectional view is formed at the rear end of the water supply pipe joint 84, and fitted into the water supply pipe 26. The water supply pipe holder 86 is fitted onto the periphery of the stopper 110, and securely held in watertight condition by fixing means, that is, a screw 114 with a packing 112 interjacent between the water supply pipe holder 86 and the main body 83.

With the system constructed as described above, the hot water 28 sucked in by the pump 10 and discharged via the water supply pipe 26 is led into the orifice 90 for spouting water, and due to a narrow sectional area of a passage for the hot water 28, a discharge pressure is amplified, producing a high water pressure and water jet. Manipulation of the nozzle 16 causes the water jet from the orifice 90 to beat at the surface of the body of an user.

The water supply pipe 26 has a small diameter for pressurization of the hot water being discharged, and linked with the nozzle 16 larger in diameter than the water supply pipe to allow the user to hold the nozzle with ease. The hot water 28 discharged under pressure through the water supply pipe 26 increases a discharge pressure thereof after flowing through a flow path of further narrowed cross sectional area inside the nozzle 16, and is spouted out of the orifice 90 as a water jet.

As the surface of the nozzle 16 from the main body 83 and the water supply pipe holder 86 towards the water supply pipe 26 is curved moderately, the nozzle 16 fits the user's palm with ease so that the user can cause a water jet to beat at the surface of the body freely while holding the nozzle with appropriate strength. The user can drive or stop the pump 10 quickly by manipulating the operation switch 18, and, for example, cause a water jet to beat at the surface of the body after determining a direction of water jet spouting from the nozzle 16, demonstrating excellent operability of the system.

As the nozzle 16 has the tapered surface 92 around the orifice 90 for injecting water, inclined at the tilt angle θ in a receding fashion, intervals between the front end surface of the nozzle 16 and the body are widened radially around the orifice 90. As a result, a velocity of water flow is decreased, and pressure of diffused water flows is diminished, preventing sticking of the nozzle 16 to the body.

Further, by varying the tilt angle, θ1, θ2, of the tapered surface 92 locally as shown in FIG. 9, where θ1≠θ2, a likelihood of the sticking phenomenon is further reduced. The tilt angle of the tapered surface may be set by not only a moderately inclined surface but also a surface with protrusions and depressions formed thereon.

Figure 11:
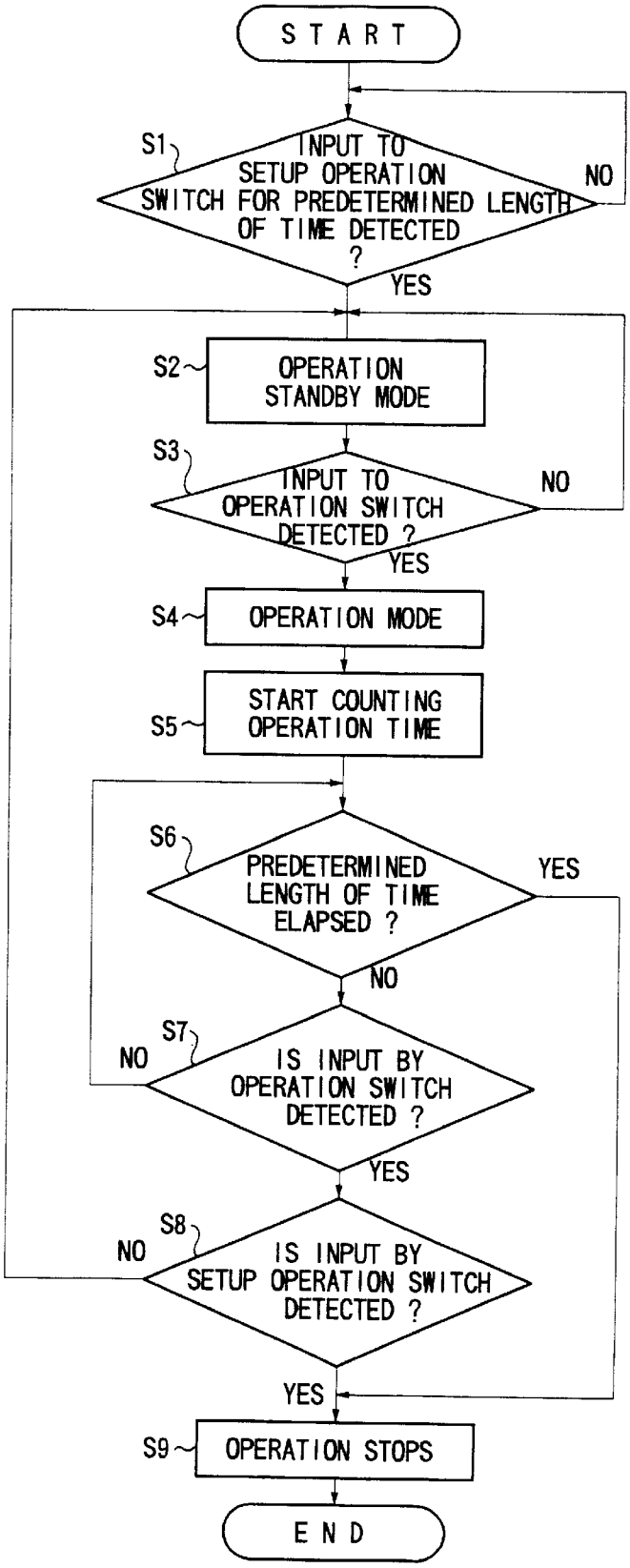
FIG. 11 a flow chart showing a mode of operation from start to suspension of the operation.

Now, operation of the water jet generating system in a bathroom according to the invention is described with reference to FIG. 11.

In step S1, the CPU 46 performs sampling of the setup operation switch 14 via the switch input detection circuit 54, checking whether or not there has been input into the switch for a predetermined length of time in succession. In case that there has been no input into the switch in succession, monitoring of input into the switch is continued. In the affirmative case, the operation proceeds to a step S2.

In step S2, upon detection of input into the setup operation switch 14 for a predetermined length of time in succession, the CPU 46 proceeds to an operation standby mode, whereupon a condition restricting safety mechanism is released. In the operation standby mode, inadvertent touch on the switch does not cause spouting out of water jet. Once in the operation standby mode, the CPU permits the pump 10 to be driven forthwith upon detection of input by the operation switch 18. Accordingly, the operation switch 18 functions as an emergency stop switch, and upon detection of new input into the operation switch 18, the CPU 46 stops driving the pump 10, and release the operation from the operation standby mode, causing it to proceed to an OFF condition forcibly.

In step S3, the CPU 46 performs sampling of input into the operation switch 18 in the operation standby mode via the switch input detection circuit 56, and decides whether or not input has been detected. In the affirmative case, the operation proceeds to a step S4.

In step S4, the operation shifts to an operation mode. In the operation mode, the relay contact 20S of the relay 20R is closed, driving the pump 10 by supplying an AC voltage thereto. Water is spouted out of the nozzle 16, enabling massaging by the water jet.

In step S5, upon shifting to the operation mode, the CPU 46 starts counting operating time of the pump 10. In step S6, the CPU 46 checks whether or not a predetermined length of time has elapsed since start of operation of the pump 10. If not, the operation proceeds to a step S7, and in the affirmative case, to a step S9.

In the step S7, the CPU 46 monitors input by the operation switch 18. Upon detection of input by the operation switch 18, the pump 10 is stopped, and the operation is shifted to the operation standby mode, proceeding to a step S8. If not, the operation reverts to the step 86 again while driving the pump 10 is driven.

In the step S8, the CPU 46 checks whether or not input by the setup operation switch 14 has been detected. If not, the operation reverts to the step S2, monitoring input by the operation switch 18. In case that input by the setup operation switch 14 is detected, the operation proceeds to the step S9, releasing the operation standby mode, and the operation comes to a stop.

There are the following variations in embodying the invention.

a) Tap water may be spouted out of a nozzle provided in place of a shower nozzle, or tap water heated at a desired temperature by means of a hot water supply unit may be spouted out.

b) In case that a supplementary water heater, whereby the hot water 28 is circulated around through the bathtub 4 and heated, is connected to the system, the hot water 28 in the bathtub 4 may be spouted out by a discharge pressure of a pump of the supplementary water heater by linking the nozzle 16 and the water supply pipe 26 to a connection port.

c) The water jet generating system in a bathtub of the invention may be used in combination with the supplementary water heater while heating tap water by acting the hot water supply unit thereof.

d) Although the invention is described as a massage system, the invention can be used as a means for generating water jet in the bathtub 4.

e) It is possible to apply the present invention employing cold water although the case employing hot water is explained in the embodiments.

As described hereinbefore, the invention can provide the effects of a water jet at an appropriate pressure, spouted by sucked water from a water source. The water jet is generated in the hot water in the bathtub so as to beat at the skin of the body selectively by manipulating the nozzle with the result that excellent massaging effects due to pressurization and impact of the water jet can be provided by proper repetition of start, continuation, and release of operation.

Further, since the operation of the pump can be performed by a phase in manipulation of the setup operation switch and the operation switch, there is no inadvertent operation, enhancing safety and economics.

Although there has been described above the construction, operation, and effects of a preferred form of the invention, it will be appreciated that the water jet massaging system according to the invention is not limited thereto. Accordingly, any and all modifications, variations, equivalent arrangements which may occur to those skilled in the art should be considered to be within the scope of the invention.

What is claimed is:

1. A water jet generating system for a bath comprising:

a water intake immersed in water in the bath.

water jet generating means provided outside the bath for generating a water jet, said means having a pump for evacuating water from the bath through the water intake;

water jet spraying means connected to the water jet generating means for spraying jet water into the bath;

control means for controlling the operation of the pump;

power source means for supplying power to the control means and for supplying driving power having low voltage to the pump;

the power source means located at a point remote from the water jet generating means;

the water jet generating means having a setup operation switch, and the water jet spraying means having an operation switch, wherein the control means operates the pump when it receives an input from the operation switch after receiving a setup instruction from the setup operation switch.

2. A water jet generating system for a bath, comprising:

a water intake located in the bath;

a pump located outside the bath and recirculating water from the water intake;

water jet spraying means located in the bath and connected to an outlet of the pump for spraying water back into the bath;

a main system operation switch located outside the bath;

an auxiliary operation switch mounted to the water jet spraying means; and control means powered by a stepped-down voltage for turning on the pump upon successive actuation of the main system operating switch followed by the auxiliary operation switch.

3. A method for generating at least one water jet in a bath and comprising the steps:

actuating a main system operation switch, located outside the bath, to enable standby operation;

selectively pumping water from the bath;

enabling the control device to begin the selective pumping of recirculating water upon successive actuation of the main system operation switch and then the auxiliary operation switch;

recirculating pumped water through at least one water jet spraying device;

directing water sprayed from the water jet spraying device back into the bath;

providing an auxiliary operation switch located at the water jet spraying device; and providing a stepped-down voltage to a control device.

4. The method of claim 3, together with the steps, implemented by the control device, of:

counting elapsed time that passes after enabling of pumping;

comparing the elapsed time to a preselected value;

terminating system operation when the elapsed time is detected; and terminating system operation prior to detection of the elapsed time if detection occurs of further auxiliary operation switch actuation followed by further actuation of the main system operation switch.

5. The method set forth in claim 4 further comprising the step of returning to standby operation prior to detection of the elapsed time, when actuation of the auxiliary operation switch occurs, and there is no further actuation of the main system operation switch.

* * * * *